US005107800A

United States Patent [19]

Araki et al.

[11] Patent Number: 5,107,800

[45] Date of Patent: Apr. 28, 1992

[54] SUCTION APPARATUS FOR ENGINE

[75] Inventors: Makoto Araki; Tetsuji Yahiro; Katsunori Morimune, all of Hiroshima, Japan

[73] Assignee: Mazda Motor Corporation, Hiroshima, Japan

[21] Appl. No.: 693,618

[22] Filed: Apr. 30, 1991

[30] Foreign Application Priority Data

May 1, 1990 [JP] Japan ..... 2-115619

[51] Int. Cl.[5] ..... F02M 35/10

[52] U.S. Cl. ..... 123/52 MB

[58] Field of Search ..... 123/52 M, 52 MB, 52 MC, 123/52 MF, 52 ML, 52 MV

[56] References Cited

U.S. PATENT DOCUMENTS 4,858,570 8/1989 Matsumoto et al. ..... 123/52 MV
5,040,495 8/1991 Harada et al. ..... 123/52 MB

FOREIGN PATENT DOCUMENTS 54-9316 1/1979 Japan .
0185954 10/1983 Japan ..... 123/52 MB
0017226 1/1985 Japan ..... 123/52 MB
61-190158 8/1986 Japan .
0032223 2/1987 Japan ..... 123/52 M
0094027 4/1988 Japan ..... 123/52 M
0159618 7/1988 Japan ..... 123/52 M
0196157 8/1990 Japan ..... 123/52 MB

*Primary Examiner*—David A. Okonsky

[57] ABSTRACT

This invention relates to an engine suction apparatus in which a tuning frequency of pressure-vibration characteristics of a suction path on the upstream side of a throttle body coincides with a frequency of a pressure vibration applied from a suction port to the suction path at an idling engine speed. The suction apparatus includes an idling path, branching from the suction path on the upstream side of the throttle body, for supplying intake air in an idling state, and a resonance silencer which resonates at the tuning frequency to reduce noise is connected to the idling path.

13 Claims, 3 Drawing Sheets

SUCTION APPARATUS FOR ENGINE

BACKGROUND OF THE INVENTION

The present invention relates to a suction apparatus for an engine, which can reduce noise based on suction noise in an engine room.

Conventionally, in order to reduce engine noise, a technique disclosed in Japanese Patent Laid-Open No. 60-22021 is known. In the technique described in this prior art, a suction path is connected to resonance chambers via tubular communication members, and the resonance chambers are coupled to each other via a coupling pipe in which a switching valve is inserted. The switching valve is switching-controlled in accordance with an engine speed, thereby reducing a noise level.

However, as described above, in the prior art arrangement in which a silencer is directly connected to the suction path to reduce noise of an air intake system, a large silencer is required. For this reason, when a space around an engine is narrow, it is difficult to arrange the silencer.

More specifically, the suction path in which a throttle valve is inserted has a relatively large path area, and the resonance chamber for attenuating a pressure vibration in this portion inevitably becomes large. In recent years, an engine room is confined, and the position of an air cleaner is limited. As a result, in some existing engines, the length of the suction path must be set to undesirably increase suction noise since the noise is tuned to the frequency of a pressure vibration applied from a suction port to the suction path at an idling engine speed in consideration of pressure-vibration characteristics of the suction path at the upstream side of a throttle body. In these engines, suction noise becomes conspicuous in an idling state in which the noise level of the entire engine is lowered. For this reason, a demand has arisen for a compact silencer structure which can reduce suction noise which is tuned in the idling state.

SUMMARY OF THE INVENTION

The present invention has been made in consideration of the above situation, and has as its object to provide a suction apparatus for an engine, which can effectively reduce suction noise which is tuned to an idling engine speed by a compact structure.

In order to solve the above-described problems, and to achieve the above object, according to one aspect of the present invention, an engine suction apparatus in which a tuning frequency of pressure-vibration characteristics of a suction path on an upstream side of a throttle body coincides with a frequency of a pressure vibration applied from a suction port to the suction path at an idling engine speed, comprises an idling path, branched from a suction path portion on the upstream side of the throttle body, for supplying intake air in an idling state, and silencer means which resonates at the tuning frequency to reduce noise is connected to the idling path.

In the suction apparatus with the above arrangement, the silencer means is connected to the idling path. The path area of the idling path is smaller than that of the suction path. Therefore, the structure of the silencer means required for attenuating a pressure vibration generated in the idling path by resonance can be rendered compact to obtain a sufficient silencer effect. Since the silencer means can be rendered compact, a space around an engine can be effectively utilized to constitute a compact suction apparatus.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENT

An arrangement of a suction apparatus for an engine according to an embodiment of the present invention will be described in detail below with reference to the accompanying drawings.

Figure 1:
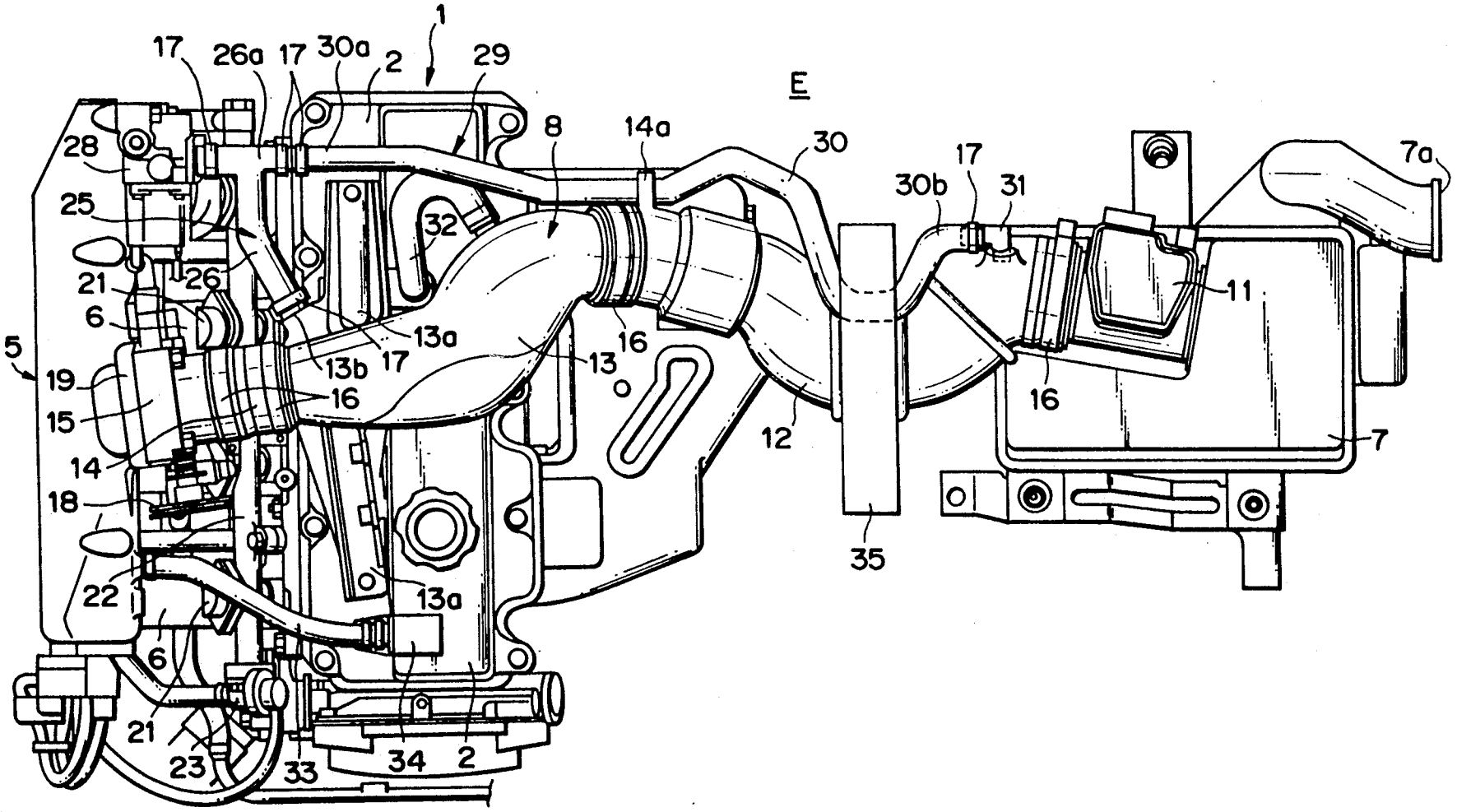
FIG. 1 is a plan view showing an engine comprising a suction apparatus according to an embodiment of the present invention.

FIG. 1 shows a plan structure of a vertical engine E provided with a suction apparatus of this embodiment. The engine E is disposed below seats of a cab-over type vehicle, and a lower portion on the drawing surface of FIG. 1 corresponds the front side of the vehicle.

An engine main body (tandem four-cylinder engine) 1 comprises a head cover 2 on an upper portion of a cylinder head (not shown). The suction apparatus for supplying intake air to the engine main body 1 comprises a surge tank 5 located on one side (on the left side in FIG. 1) of the engine main body 1, and extending in the back-and-forth direction of the vehicle body, and independent suction paths 6 extending from the surge tank 5 to the respective cylinders of the engine main body 1. The suction apparatus further comprises an air cleaner 7 arranged on the other side (on the right side in FIG. 1) of the engine main body 1, and an upstream suction path 8, crossing above the engine main body 1, for connecting substantially the central portions of the upper surfaces of the air cleaner 7 and the surge tank 5.

More specifically, the box-like air cleaner 7 is arranged on the right side in FIG. 1 to be separated from the engine main body 1. An air intake port **7*a* of the air cleaner 7 is open sideways along the widthwise direction of the vehicle body. An air flow sensor 11 for detecting an intake air flow rate is arranged on a discharge portion formed in the upper surface of the air cleaner 7. An air hose 12 formed of, e.g., plastic, and a metal air duct 13 are connected in turn to the air flow sensor 11. The terminal end portion of the air duct 13 is connected to a throttle body 15 via a short air hose 14. The respective connecting portions are firmly fastened by fastening bands 16**.

A throttle valve (not shown) is interposed in the throttle body 15 described above. The throttle valve is opened/closed by an accelerator lever which is operated in accordance with a depression of an accelerator pedal (not shown). The downstream-side end portion of the throttle body 15 is fastened to a flange portion 19 formed on the central upper portion of the surge tank 5. Intake air introduced into the internal space of the surge tank 5 and scattered there is introduced into the respective cylinders via the independent suction paths 6 connected to the lower surface of the surge tank 5. Injectors 21 are arranged in downstream portions of the independent suction paths 6. Each injector 21 injects fuel supplied from a corresponding fuel pipe 22 into a combustion chamber of the corresponding cylinder. A fuel pressure regulator 23 for maintaining a constant pressure of fuel supplied to each injector 21 is connected to one end of the fuel pipe 22.

The air duct 13 is cast by a metal which is not easily influenced by an engine temperature in operation. A bracket 13*a*, extending in the back-and-forth direction of the vehicle body, for supporting the middle portion of the air duct 13 from below is fixed on the head cover 2 of the engine main body 1. An idling path 25 for supplying intake air in an idling state while bypassing the throttle body 15 is connected between the middle portion of the air duct 13 and the surge tank 5.

An idling air outlet 13*b* is formed in the side portion of the downward end portion of the air duct 13. One end of a rubber pipe 26 constituting the idling path 25 is connected to the air outlet 13*b*, and is fixed by a clip 17. The other end of the rubber pipe 26 is connected to an in-flow port of an ISC valve 28 for adjusting an idling air flow rate, and is similarly fixed by the clip 17. The ISC valve 28 is mounted on the side surface of the surge tank 5, and air subjected to flow rate control is supplied into the surge tank 5. In this embodiment, the ISC valve 28 is constituted by an electromagnetic solenoid valve. The ISC valve 28 is vibrated at a constant frequency of 125 Hz, and can control an idling air flow rate of air flowing through the idling path 25 to an arbitrary valve by changing its duty ratio between 0% and 100%.

In the suction apparatus with the above-described arrangement, the upstream suction path 8 extending from the throttle body 15 to the air flow sensor 11 (i.e., the air cleaner 7) located on the upstream side of the throttle body 15 has a structure which is vibrated since its air column-vibration characteristics are tuned to a pressure vibration frequency generated in correspondence with suction pulsations at the idling engine speed upon setting of the path length and area of the path 8.

As the characteristic feature of the present invention, in order to attenuate the pressure vibration in an idling state, a resonance silencer 29 is connected to the idling path 25 at the upstream side of the ISC valve 28. In this embodiment, the resonance silencer 29 is constituted by a pipe member 30 formed of, e.g., rubber. A connecting portion 26*a* is formed at the bent portion of the rubber pipe 26 constituting the idling path 25 to be branched from the bent portion. One end portion 30*a* of the pipe member 30 is connected to the connecting portion 26*a*, so that the internal spaces of the two members communicate with each other. A coupling pipe (not shown) is fitted in the connecting portions 26*a* and 30*a* of the two pipe members 26 and 30, and the end portions of the connecting portions are fastened to the coupling pipe by clips 17, thereby coupling the two pipe members 26 and 30 to each other.

The pipe member 30 constituting the resonance silencer 29 has a predetermined length corresponding to the length of the suction path extending from the throttle body 15 to the air flow sensor 11. The pipe member 30 is arranged to be bent along the upstream suction path 8. The other end portion 30*b* of the pipe member 30 is closed, and is attached, via another clip 17, to a fixing member 31 fixed to the air hose 14 near the air flow sensor 11. The intermediate portion of the pipe member 30 is held by a stopper 14*a* formed on the air hose 14.

Note that an upstream blow-by gas path 32 is connected to the air duct 13. One end of the upstream blow-by gas path 32 is open into the head cover 2, and the other end thereof is open to the upstream portion of the air duct 13. A downstream blow-by gas path 33 is connected to the head cover 2. One end of the downstream blow-by gas path 33 is connected to a pressure valve (PCV) 34 disposed on the head cover 2, and the other end thereof is directly connected to the surge tank 5. A seal member 35 for eliminating the influence of heat to the air cleaner 7 side by an exhaust system of the engine E is arranged midway along the upstream suction path 8.

According to the suction apparatus of this embodiment with the above-described arrangement, in an idling state with the throttle valve closed, a variation in pressure generated in the suction port is transmitted toward the upstream side upon operation of the engine main body 1. More specifically, the variation in pressure is transmitted from the surge tank 5 to the suction path 8 on the upstream side of the throttle body 15 via the idling path 25, and vibrates an air column in this portion, thereby generating a large pressure vibration in a tuned state, and causing noise. In other words, a length from the mounting position of the suction path 8 on the air cleaner 7 to the position of the throttle valve in the throttle body 15 corresponds to a ¼ wavelength with respect to 125 Hz as the driving frequency of the ISC valve 28. As a result, the driving frequency of the ISC valve 28 resonates in the suction path 8, and amplified vibration noise in the ISC valve 28 is discharged from the air intake port 7*a* of the air cleaner 7 into the engine room, thus causing noise.

However, as described above, the resonance silencer 29 is connected to the idling path 25. For this reason, the silence 29 resonates at the tuning frequency at the idling engine speed in a tuned state, and attenuates the pressure vibration in the idling path 25. As a result, the pressure vibration in the upstream suction path 8 can be effectively suppressed, and suction noise can be reduced.

When the pressure vibration is attenuated, the idling path 25 has a smaller path diameter than that of the suction path 8, and the pressure vibration can be effectively attenuated by a resonance effect of the small-diameter pipe member 30. Since the pipe member 30 is arranged along the suction path 8, its installation space can be easily assured. In addition, since the pipe member 30 is deformed to follow an engine vibration, a pressure vibration attenuation effect can be reliably maintained.

In order to examine the effects of the arrangement of the present invention, the inventors of the present application conducted the following experiments. The experiment contents and experiment results will be described in detail below.

Figure 2:
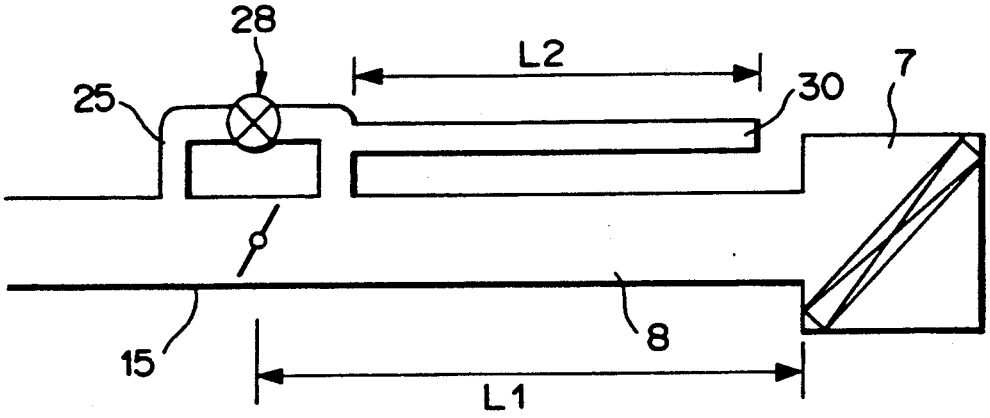
FIG. 2 shows a schematic model of an arrangement of the suction apparatus of this embodiment.

FIG. 2 shows a model of the suction apparatus used in the experiments. In FIG. 2, the same reference numerals denote the same parts as in the suction apparatus shown in FIG. 1, and a detailed description thereof will be omitted. As shown in FIG. 2, the length of the suction path 8, more specifically, the length from the mounting position of the suction path 8 on the air cleaner 7 to the position of the throttle valve in the throttle body 15 is represented by symbol L1, and the length of the pipe member 30 constituting the resonance silencer 29, more specifically, the length from the mounting position of the pipe member 30 on the idling path 25 to its closed distal end portion is represented by symbol L2. In these experiments, the length L1 of the suction path 8 was set to be 700 mm.

First Experiment

The following first experiment was carried out to examine optimal values of the length L2 and the pipe diameter of the pipe member 30 connected to the idling path 25.

Measurement Conditions (1) Engine speed; 800 rpm (idling state)
(2) Measurement position of noise level; position 10 cm from vehicle body sideways at mounting position of air cleaner 7
(3) Measurement device; FFT (Type CF-350; ONO SOKKI K.K.)
(4) Driving frequency of ISC valve 28; 125 Hz

Figure 3:
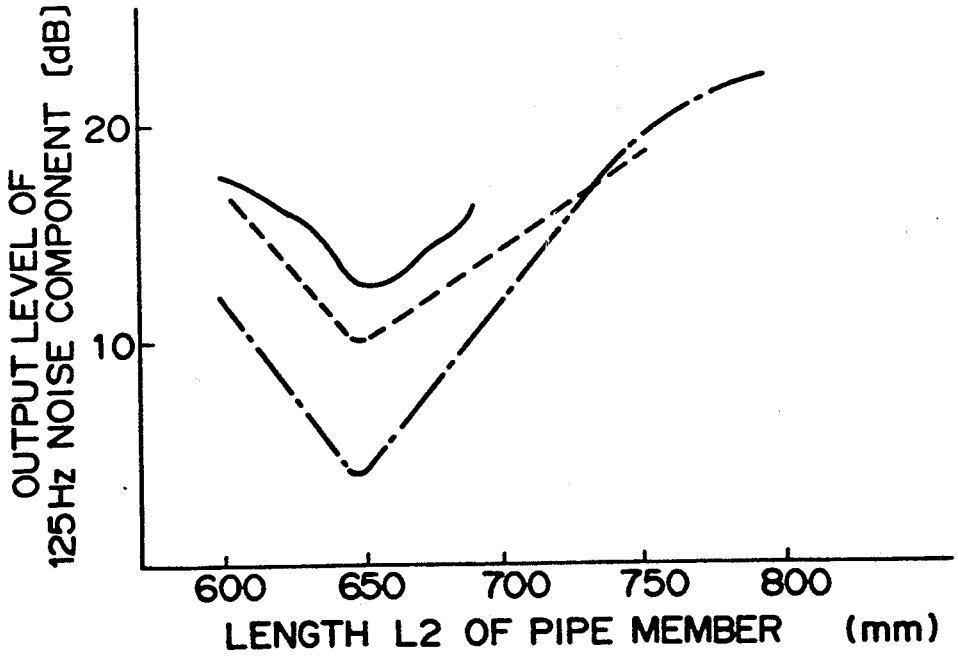
FIG. 3 is a graph showing the relationship between the length and pipe diameter of a pipe member, and noise.

Measurement Parameters (A) Pipe diameter of pipe member 30; 3 types ($\phi$7, $\phi$12, and $\phi$25)
(B) Length L2 of pipe member 30; 600 to 800 mm FIG. 3 shows the measurement results of the first experiment. In FIG. 3, a solid curve represents a change in output level of a 125-Hz noise component when the length L2 of the pipe member 30 is changed while the pipe diameter of the pipe member 30 is set to be $\phi$7, a broken curve represents a change in output level of a 125-Hz noise component when the length L2 of the pipe member 30 is changed while the pipe diameter of the pipe member 30 is set to be $\phi$12, and an alternate long and short dashed curve represents a change in output level of a 125-Hz noise component when the length L2 of the pipe member 30 is changed while the pipe diameter of the pipe member 30 is set to be $\phi$25.

As can be understood from the measurement results shown in FIG. 3, the pipe member having a pipe diameter of $\phi$12 and a length L2 of 650 mm is most effective to suppress at least an output of the 125-Hz noise component, i.e., to reduce noise.

Second Experiment

The following second experiment was carried out to examine a change in noise level depending on the presence/absence of connection of the pipe member 30 whose length was set to be 650 mm on the basis of the first experiment results.

Measurement Conditions (1) Engine speed; 800 rpm (idling state)
(2) Measurement position of noise level; position 10 cm from vehicle body sideways at mounting position of air cleaner 7
(3) Measurement device; FFT (Type CF-350; ONO SOKKI K.K.)
(4) Driving frequency of ISC valve 28; 125 Hz

Measurement Parameters (A) Connect pipe member 30 having length of 650 mm to idling path 25
(B) Connect no pipe member 30 to idling path 25

Figure 4:
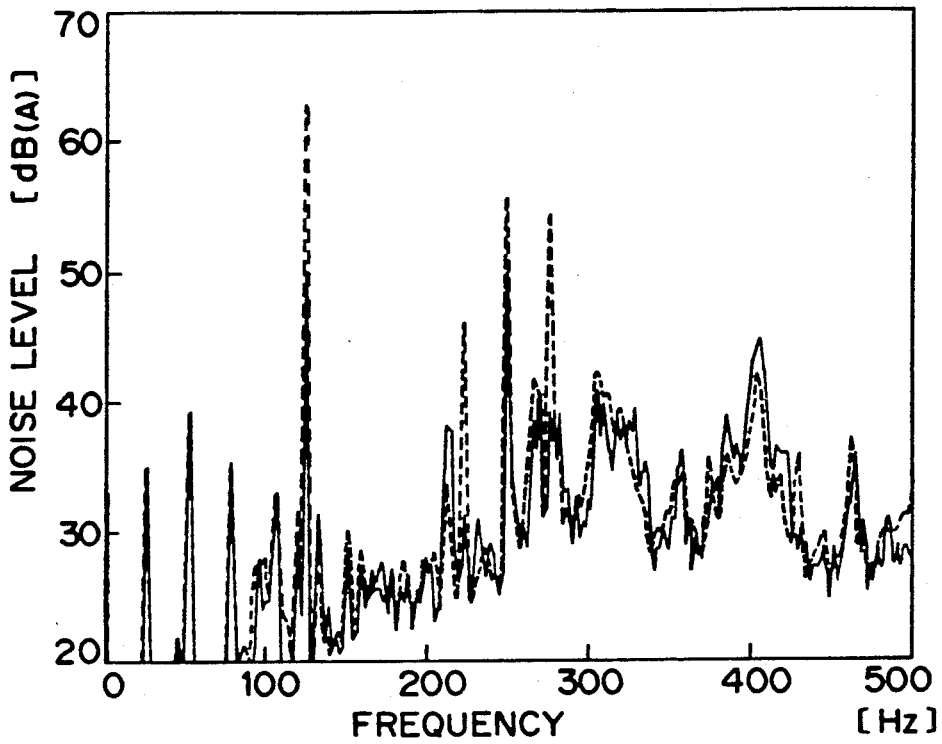
FIG. 4 is a graph showing a change in noise level depending on the presence/absence of connection of the pipe member.

FIG. 4 shows the measurement results of the second experiment. In FIG. 4, a solid curve represents a noise level measured when the pipe member 30 is connected to the idling path 25, and a broken curve represents a noise level measured when no pipe member 30 is connected to the idling path 25.

As can be understood from the measurement results shown in FIG. 4, when the pipe member 30 constituting the resonance silencer 29 is connected, the overall noise level can be decreased as compared with a case wherein no pipe member is connected. As can be seen from FIG. 4, especially, a 125-Hz noise component can be effectively reduced, and harmonics of the 125-Hz noise component as a base tone can also be effectively reduced.

Third Experiment

In the second experiment for reducing the noise level, the frequency of reduced noise is mainly 125 Hz, and the ISC valve 28 is driven at the driving frequency of 125 Hz. Thus, the third experiment was conducted to confirm that idling noise reduced by the resonance silencer 29 is that caused by the ISC valve 28.

Measurement Conditions (1) Engine speed; 800 rpm (idling state)
(2) Measurement position of noise level; position 10 cm from vehicle body sideways at mounting position of air cleaner 7
(3) Measurement device;
(4) Length L2 of pipe member 30; 650 mm

Figure 5:
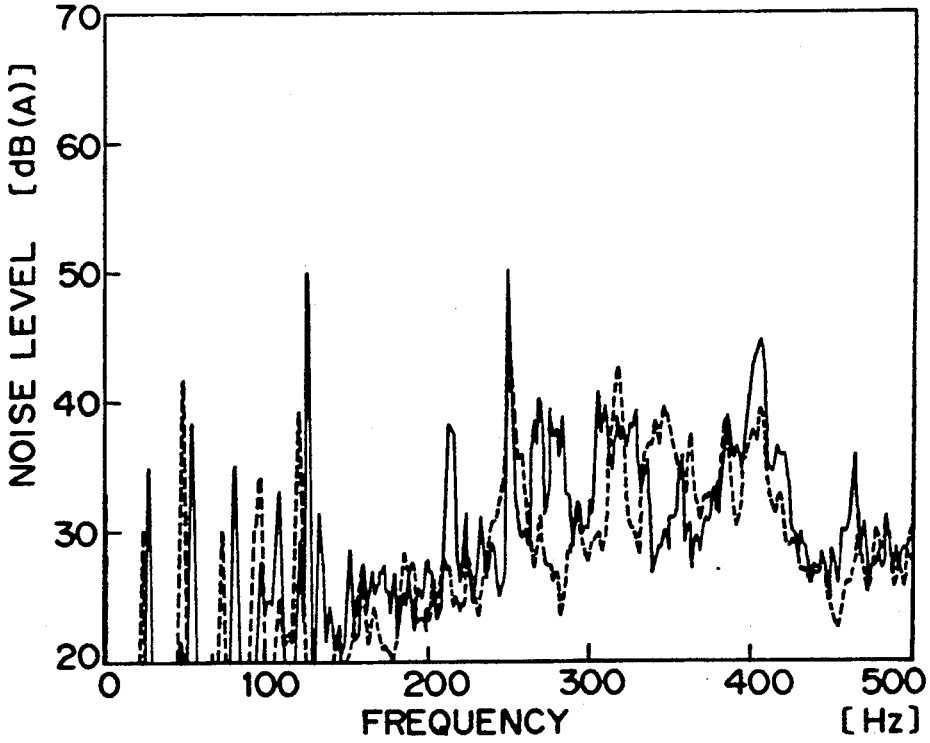
FIG. 5 is a graph showing a change in noise level depending on the presence/absence of an effect of an ISC while the pipe member is connected.

Measurement Parameters (A) ISC valve 28 is driven at 125 Hz
(B) ISC valve 28 is not driven at 125 Hz FIG. 5 shows the measurement results of the third experiment. In FIG. 5, a solid curve represents a noise level when the ISC valve 28 is driven at 125 Hz. More specifically, a change in noise level represented by the solid curve is the same as the change indicated by the solid curve in FIG. 4. On the other hand, a broken curve in FIG. 5 represents a change in noise level when the ISC valve 28 is not driven. As can be understood from the measurement results shown in FIG. 5, when the pipe member 30 constituting the resonance silencer 29 is connected, noise based on a 125-Hz vibration noise component generated by the ISC valve 28 can be satisfactorily reduced.

As can be understood from the first and third experiments described above, when the resonance silencer 29 of this embodiment is arranged, the vibration noise component of the ISC valve 28 can be effectively reduced in an idling state, and the noise level in the idling state can be satisfactorily decreased.

The present invention is not limited to the arrangement of the above embodiment, and various changes and modifications may be made within the spirit and scope of the invention.

For example, in addition to the arrangement of the above embodiment, the connecting position of the idling path 25 may be varied depending on the type of engine E, and designs of the structure and position of the resonance silencer 29 connected to the idling path 25 may be appropriately changed, accordingly.

As described above, according to the present invention, the resonance silencer which resonates at a tuning frequency generated in the suction path at an idling engine speed to attenuate and reduce a pressure vibration in the idling path is connected to the idling path, branched from a path on the upstream side of the throttle body, for supplying intake air in an idling state. Thus, since the path area of the idling path is smaller than that of the suction path, a sufficient noise reduction effect can be obtained by the compact resonance silencer required for attenuating the pressure vibration generated in the idling path by resonance, and a compact suction noise reduction structure can be arranged by utilizing a space around the engine.

As many apparently widely different embodiments of the present invention can be made without departing from the spirit and scope thereof, it is to be understood that the invention is not limited to the specific embodiments thereof except as defined in the appended claims.

What is claimed is:

1. A suction apparatus for an engine, which comprises:

a suction path located at an upstream side of a throttle body, a tuning frequency of pressure-vibration characteristics of said suction path coinciding with a frequency of a pressure vibration applied from a suction port of the engine in an idling state into said suction path;

an idling path, branched from said suction path on the upstream side of the throttle body, for supplying intake air in the idling state; and silencer means which is connected to said idling path, and resonates at the tuning frequency to reduce noise.

2. The apparatus according to claim 1, wherein said silencer means comprises a resonance silencer.

3. The apparatus according to claim 2, wherein said resonance silencer comprises an elongated pipe member having a closed distal end.

4. The apparatus according to claim 3, wherein said pipe member is connected to said idling path, so that said pipe member is open to said idling path at a proximal end portion thereof.

5. The apparatus according to claim 3, wherein said pipe member extends along said suction path.

6. The apparatus according to claim 5, wherein the closed distal end portion of said pipe member is fixed to said idling path.

7. The apparatus according to claim 4, which further comprises:

a valve, arranged midway along said idling path, for regulating a flow rate of air flowing through said idling path; and wherein the proximal end portion of said pipe member is connected on the upstream side of said valve with respect to a flow of intake air.

8. The apparatus according to claim 7, wherein said valve comprises an electromagnetic solenoid valve which is vibrated at a predetermined driving frequency, and regulates the flow rate of air flowing through said idling path on the basis of a driving duty ratio thereof.

9. The apparatus according to claim 8, wherein said pipe member is set to have a length and a pipe diameter which are necessary for absorbing a noise component based on the driving frequency of said electromagnetic solenoid valve.

10. The apparatus according to claim 3, wherein said pipe member is formed of an elastic member.

11. The apparatus according to claim 10, wherein said pipe member is connected to said idling path, so that said pipe member is open to said idling path at a proximal end portion thereof.

12. The apparatus according to claim 10, wherein said pipe member extends along said suction path.

13. The apparatus according to claim 12, wherein the closed distal end portion of said pipe member is fixed to said idling path.

* * * * *